US011142914B1

(12) United States Patent
Paulin et al.

(10) Patent No.: US 11,142,914 B1
(45) Date of Patent: Oct. 12, 2021

(54) SYSTEM, METHOD AND APPARATUS FOR PROVIDING A SOUND ABSORBING COMPOSITE WALL

(71) Applicant: Valmont Industries, Inc., Omaha, NE (US)

(72) Inventors: Robert Paulin, Irmo, SC (US); Heath McCutcheon, Newberry, SC (US); Eric Haddad, Chapin, SC (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 16/994,738

(22) Filed: Aug. 17, 2020

Related U.S. Application Data

(60) Provisional application No. 62/891,448, filed on Aug. 26, 2019.

(51) Int. Cl.
*E04F 13/075* (2006.01)
*E04F 13/08* (2006.01)
*E04B 1/84* (2006.01)

(52) U.S. Cl.
CPC ..... *E04F 13/075* (2013.01); *E04B 1/84* (2013.01); *E04F 13/083* (2013.01); *E04F 13/0876* (2013.01)

(58) Field of Classification Search
None
See application file for complete search history.

(56) References Cited

U.S. PATENT DOCUMENTS

| | | | | |
|---|---|---|---|---|
| 3,260,027 | A * | 7/1966 | Page | E04C 2/043 52/602 |
| 4,138,947 | A * | 2/1979 | Pickett | E01F 1/00 104/307 |
| 6,302,784 | B1 * | 10/2001 | Berger | F24F 13/02 454/289 |
| 7,627,993 | B1 * | 12/2009 | Letizi | E04B 1/3211 52/653.1 |
| 10,400,402 | B1 * | 9/2019 | Sanders | H02G 1/08 |
| 2010/0253519 | A1 * | 10/2010 | Brackmann | G01S 19/35 340/572.1 |
| 2021/0102349 | A1 * | 4/2021 | Marandos | E01F 8/0017 |

* cited by examiner

*Primary Examiner* — Joshua K Ihezie
(74) *Attorney, Agent, or Firm* — Milligan PC LLO

(57) ABSTRACT

The present invention provides a light weight, composite wall system. According to a preferred embodiment, the present invention includes a sound absorbing wall assembly system which includes a wall beam with detachably mounted wall panels. According to further aspects of the present invention, the wall beam preferably includes an upper surface, a lower surface and a back beam surface which is connected between the upper and lower surfaces. According to further aspects of the present invention, the upper surface of the wall beam includes a corrugated rib and an upper connecting flange, and the lower surface includes a lower corrugated rib and a lower connecting flange.

16 Claims, 10 Drawing Sheets

SYSTEM, METHOD AND APPARATUS FOR PROVIDING A SOUND ABSORBING COMPOSITE WALL

RELATED APPLICATIONS

The present application claims priority to U.S. Provisional Application No. 62/891,448 filed Aug. 26, 2019.

FIELD OF INVENTION

The present invention is related in general to a composite wall and, in particular, to a system, method and apparatus for providing a sound absorbing composite wall.

BACKGROUND OF THE INVENTION

There are a variety of modular and pre-fabricated wall designs which are increasingly popular in construction. Most commonly, these wall designs include lightweight panels which are stacked and connected to enclose a given space.

Current composite wall designs are limited to eight feet typically in an L/240 design. Additionally, current composite wall designs are required to be formed of plastic-based materials which are not aesthetically pleasing such as Polyvinyl Chloride (PVC), Polypropylene (PP) and the like. These plastic-based materials also have poor sound absorbing properties. For this reason, current composite wall designs have a limited appeal compared to traditional wood and brick wall designs.

What is needed is a light weight wall system which can be over eight feet in an L/240 design. Further, a composite wall system is needed which allows for improved aesthetic appeal. Further, a composite wall system is needed which has improved sound-absorbing qualities.

SUMMARY OF THE DISCLOSURE

The present invention overcomes the limitations of the prior art by providing a light weight, composite wall system. According to a preferred embodiment, the present invention includes a sound absorbing wall assembly system which includes a wall beam with detachably mounted wall panels. According to further aspects of the present invention, the wall beam preferably includes an upper surface, a lower surface and a back beam surface which is connected between the upper and lower surfaces. According to further aspects of the present invention, the upper surface of the wall beam includes a corrugated rib and an upper connecting flange, and the lower surface includes a lower corrugated rib and a lower connecting flange.

According to further aspects of the present invention, the detachable face panel of the present invention may include a front surface having grill openings, and a rear surface which includes upper clips and lower clips. Further, the present invention may further include insulation material which is enclosed between the wall beam and the face panel to absorb sound.

According to further aspects of the present invention, the face panel of the present invention may attach to the wall beam by inserting a lower clip of the face panel over the lower connecting flange and securing the upper clip over the upper connecting flange to create a frictional fit.

Other goals and advantages of the present invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DETAILED DESCRIPTION OF THE DRAWINGS

Aspects of the present invention will be explained with reference to exemplary embodiments and examples which are illustrated in the accompanying drawings. These descriptions, embodiments and figures are not to be taken as limiting the scope of the claims. Further, the word "exemplary" is used herein to mean "serving as an example, instance, or illustration." Accordingly, any embodiment described herein as "exemplary" is not to be construed as preferred over other embodiments. Additionally, well-known elements of the embodiments will not be described in detail or will be omitted so as not to obscure relevant details.

Where the specification describes advantages of an embodiment or limitations of other prior art, the applicant does not intend to disclaim or disavow any potential embodiments covered by the appended claims unless the applicant specifically states that it is "hereby disclaiming or disavowing" potential claim scope. Likewise, the term "embodiments" does not require that all embodiments of the invention include any discussed feature or advantage, nor that it does not incorporate aspects of the prior art which are sub-optimal or disadvantageous.

As used herein, the singular forms "a", "an" and "the" are intended to include the plural forms as well, unless the context clearly indicates otherwise. Additionally, the word "may" is used in a permissive sense (i.e., meaning "having the potential to'), rather than the mandatory sense (i.e. meaning "must"). Further, it should also be understood that throughout this disclosure, unless logically required to be otherwise, where a process or method is shown or described, the steps of the method may be performed in any order (i.e. repetitively, iteratively or simultaneously) and selected steps may be omitted. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Figure 1:
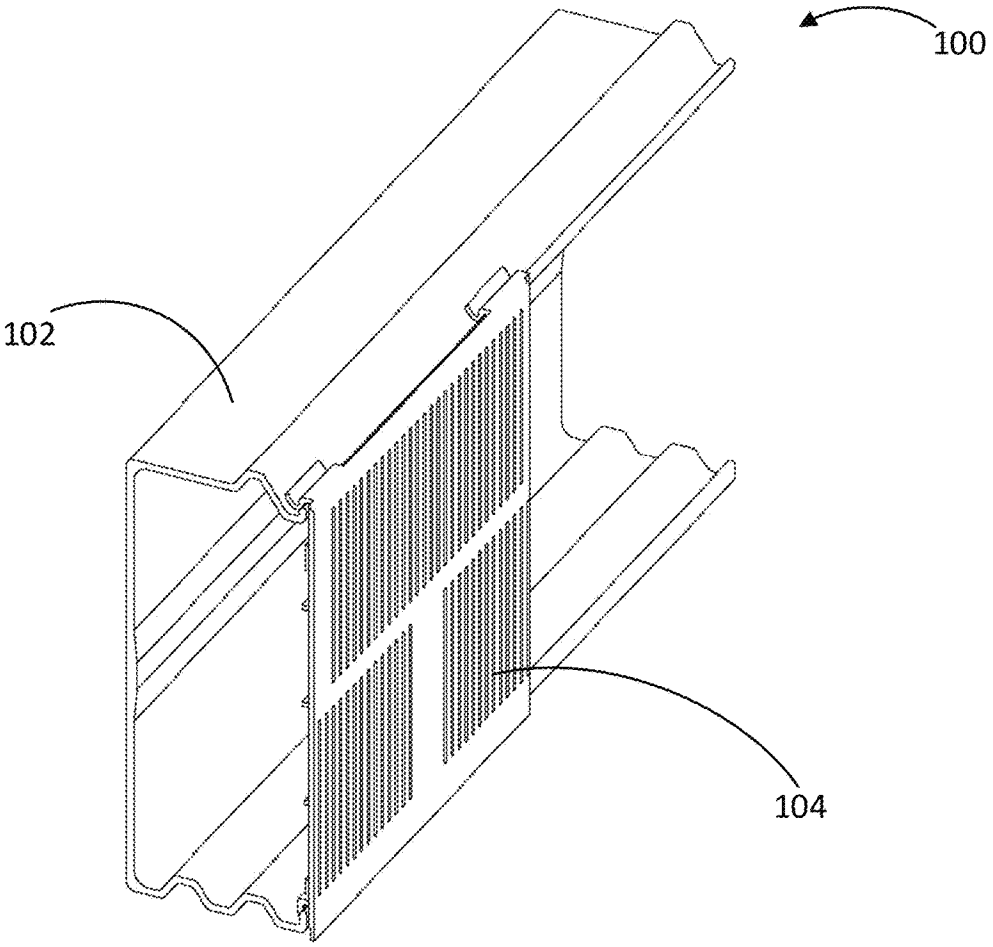
FIG. 1 shows a side, perspective view of a beam wall assembly in accordance with a first preferred embodiment of the present invention.

FIG. 1 shows a side, perspective view of a beam wall assembly 100 in accordance with a first preferred embodiment of the present invention. As shown, a beam wall assembly 100 may include an extended wall beam 102 with a detachable face panel 104. The beam wall assembly 100 preferably includes sound absorbing features as will be discussed further below. According to a preferred embodiment, the wall beam 102 may preferably be formed of fiberglass. Alternatively, the wall beam 102 may be formed of any other rigid, lightweight materials such as plastic, aluminum, or the like. As shown, the wall beam 102 is preferably hollow and formed as a shell to provide strength and stability to the beam wall assembly 100 to achieve an L/240 value at greater than 14 feet. The beam wall assembly 100 is preferably further designed so that the face panel 104 may be detachably mounted to the wall beam 102 as detailed below.

Figure 2:
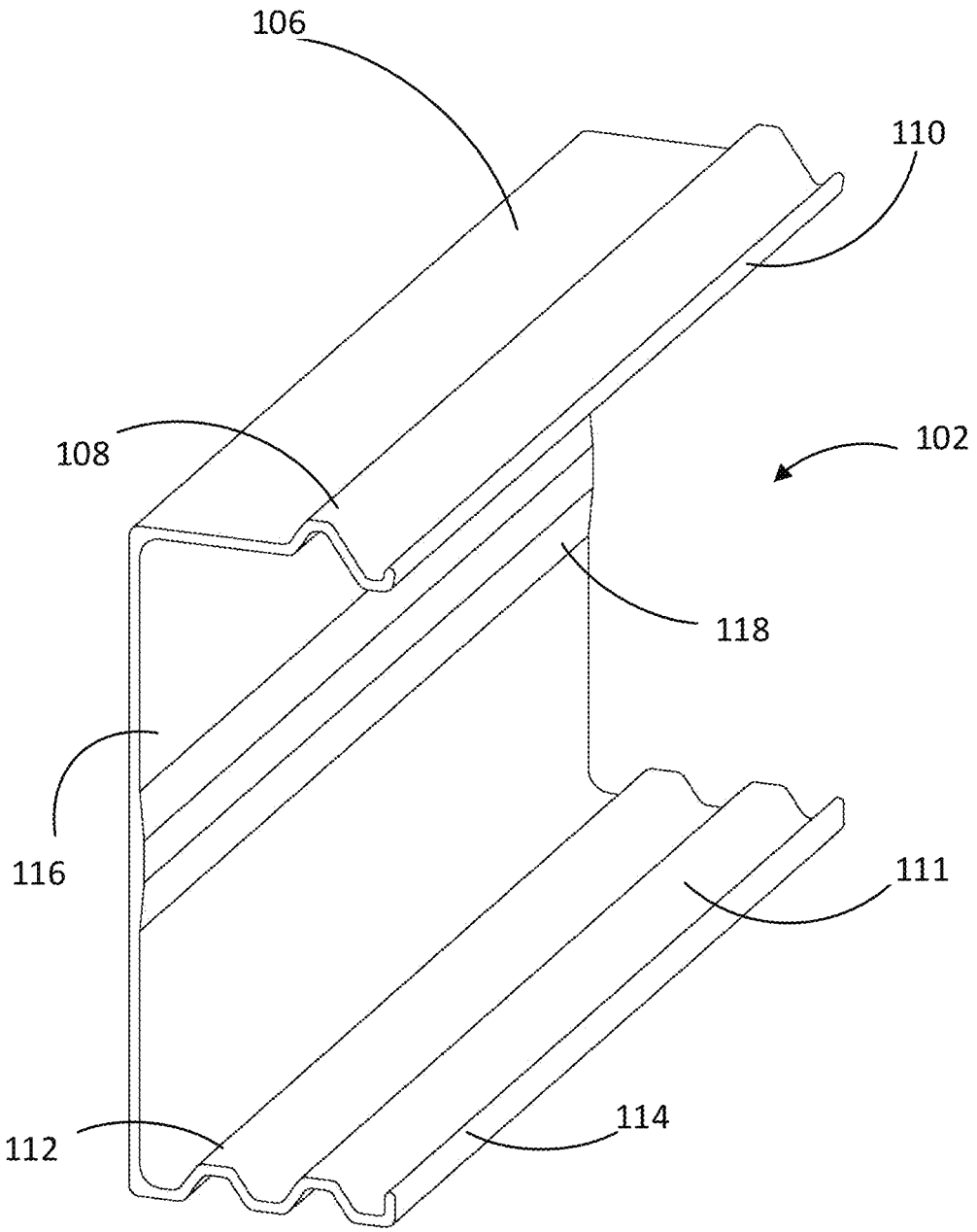
FIG. 2 shows a cutaway view of a wall beam in accordance with a first preferred embodiment of the present invention.
Figure 3:
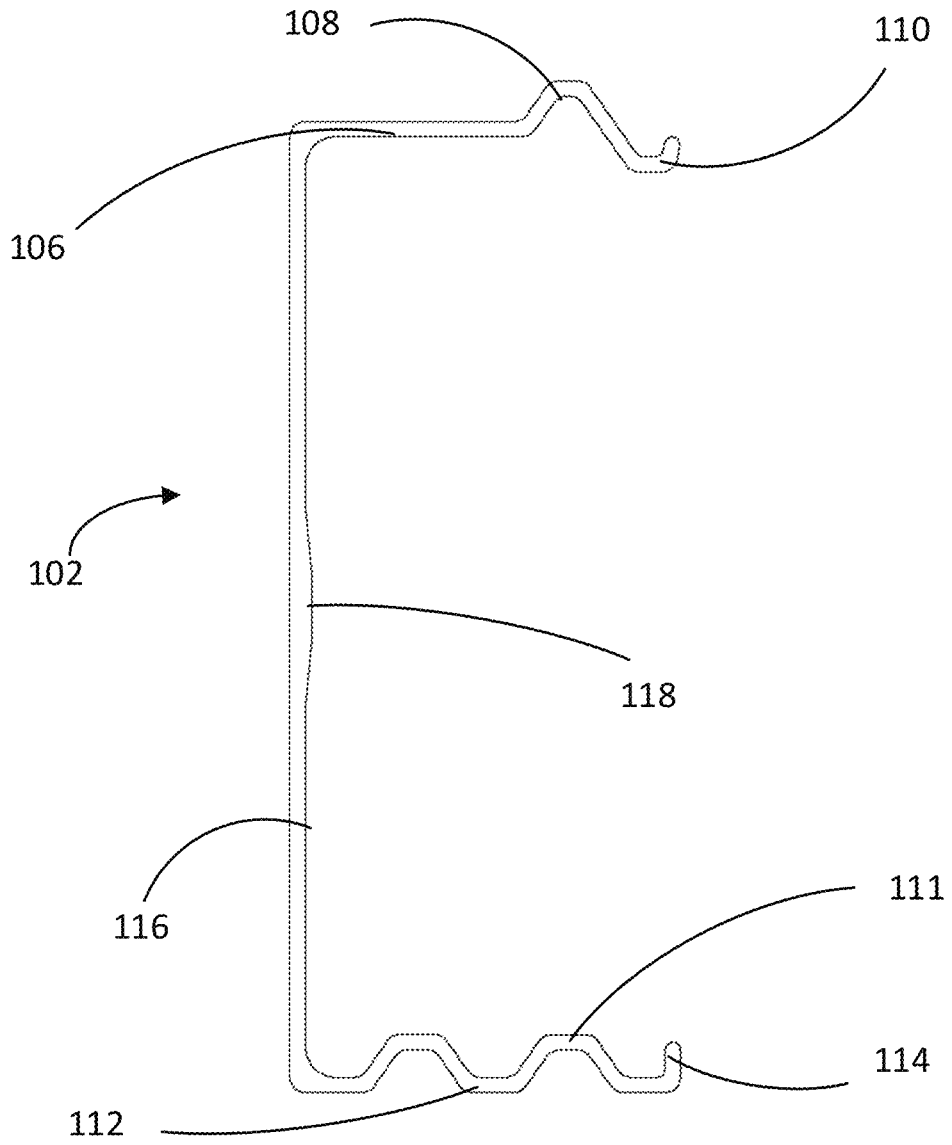
FIG. 3 shows a side cutaway view of a wall beam in accordance with a first preferred embodiment of the present invention.
Figure 9:
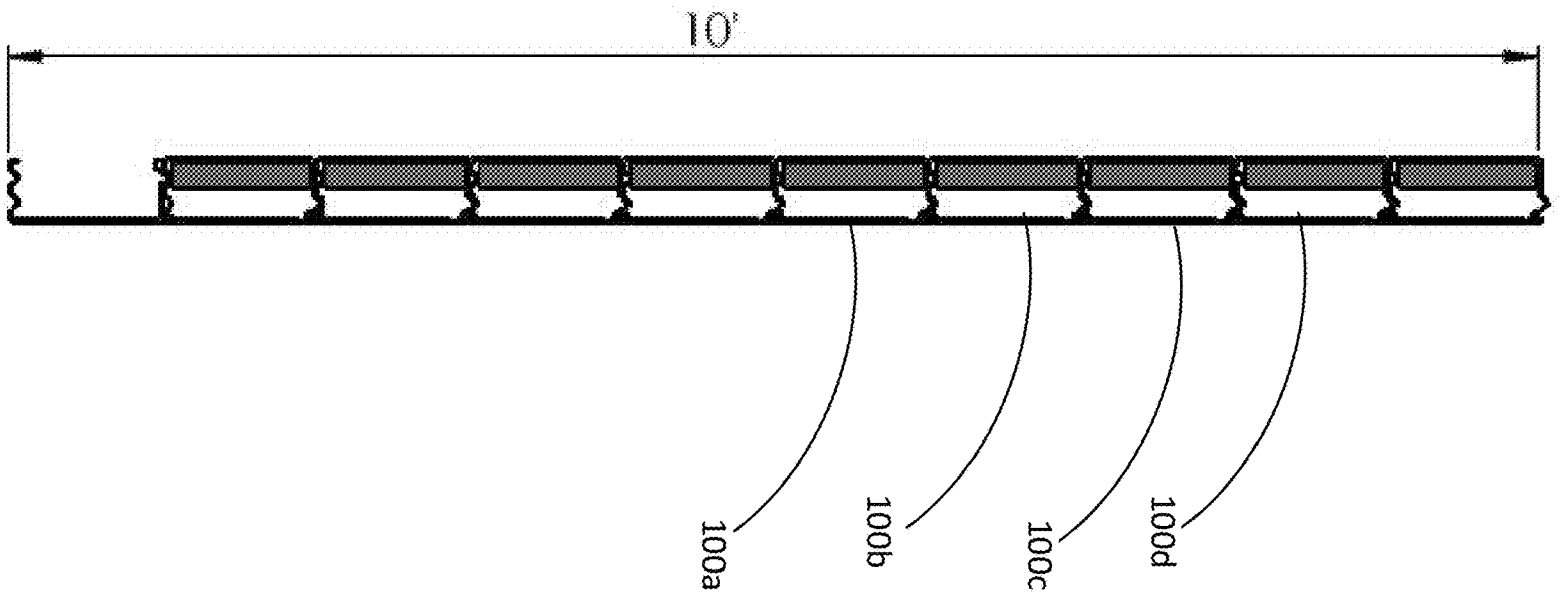
FIG. 9 shows a side view of a stacked set of beam wall assembly units in accordance with a further preferred embodiment of the present invention.
Figure 10:
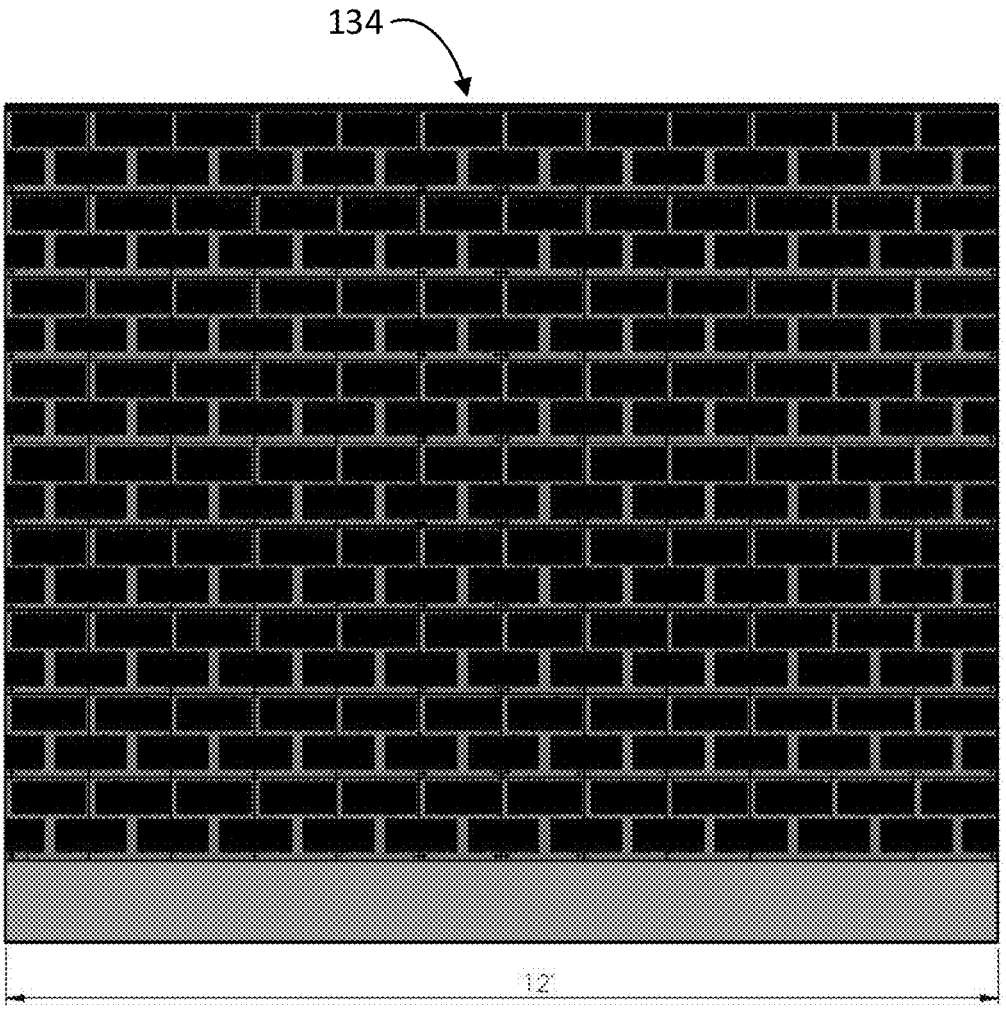
FIG. 10 shows a front view of a complete wall formed by aspects of the present invention.

With reference now to FIGS. 2 and 3, an exemplary wall beam 102 in accordance with a first preferred embodiment of the present invention shall now be discussed. FIG. 2 provides a first perspective view of an exemplary wall beam 102 and FIG. 3 shows a side cutaway view of the same. As shown, the wall beam 102 is preferably formed as a length of beam having an upper surface 106, a back beam surface 116 and a lower surface 111. As shown, the upper surface 106 preferably includes at least one corrugated rib 108 and an upper connecting flange 110. The back beam surface 116 may be smooth or may include central ridges 118 to allow for flexibility and/or added strength within the wall beam 102. The lower surface 111 may preferably include corrugated ribs 112 and a lower connecting flange 114. As shown, the top corrugated rib 108 may preferably mate with the lower corrugated ribs 112 so that one wall beam assembly 100 may be stacked on another to form a larger wall as shown in FIGS. 9 and 10.

Figure 4:
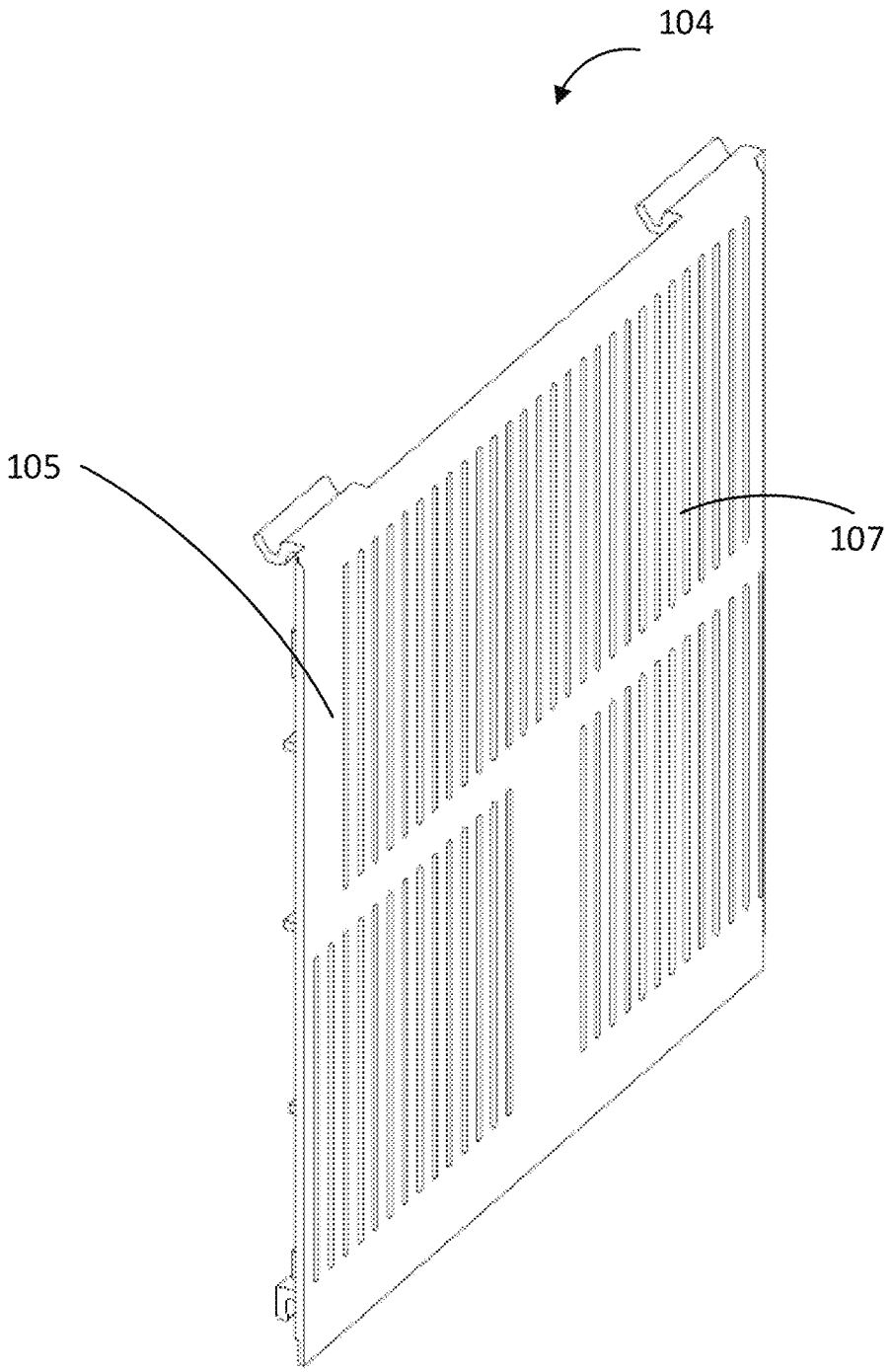
FIG. 4 shows a front, perspective view of an exemplary wall panel in accordance with a preferred embodiment of the present invention.

With reference now to FIG. 4, a front view of an exemplary face panel 104 in accordance with a preferred embodiment of the present invention shall now be discussed. As shown, the face panel 104 includes a front face 105 which preferably includes a plurality of grill openings 107 to assist with sound intake and sound absorption. According to preferred embodiments, the face panel 104 may formed of nylon plastic or the like. Alternatively, any material may be used to meet the aesthetic and weight requirements of a given installation. Importantly, the design on the front face 105 may be changed to show any given design. For example, the front face 105 may include a faux brick look which may be created by providing slotting on the front face 105 to resemble a brick face. Further, the grill openings 107 may be arranged to resemble grout lines or the like. Further, the amount of open space on the front face 105 may be changed as required. Preferably, the grill openings 107 and/or the entire front face may be covered in wired mesh or the like to prevent ingress of debris and flying insects. Any such mesh may be attached via ultrasonic welding or other process.

Figure 5:
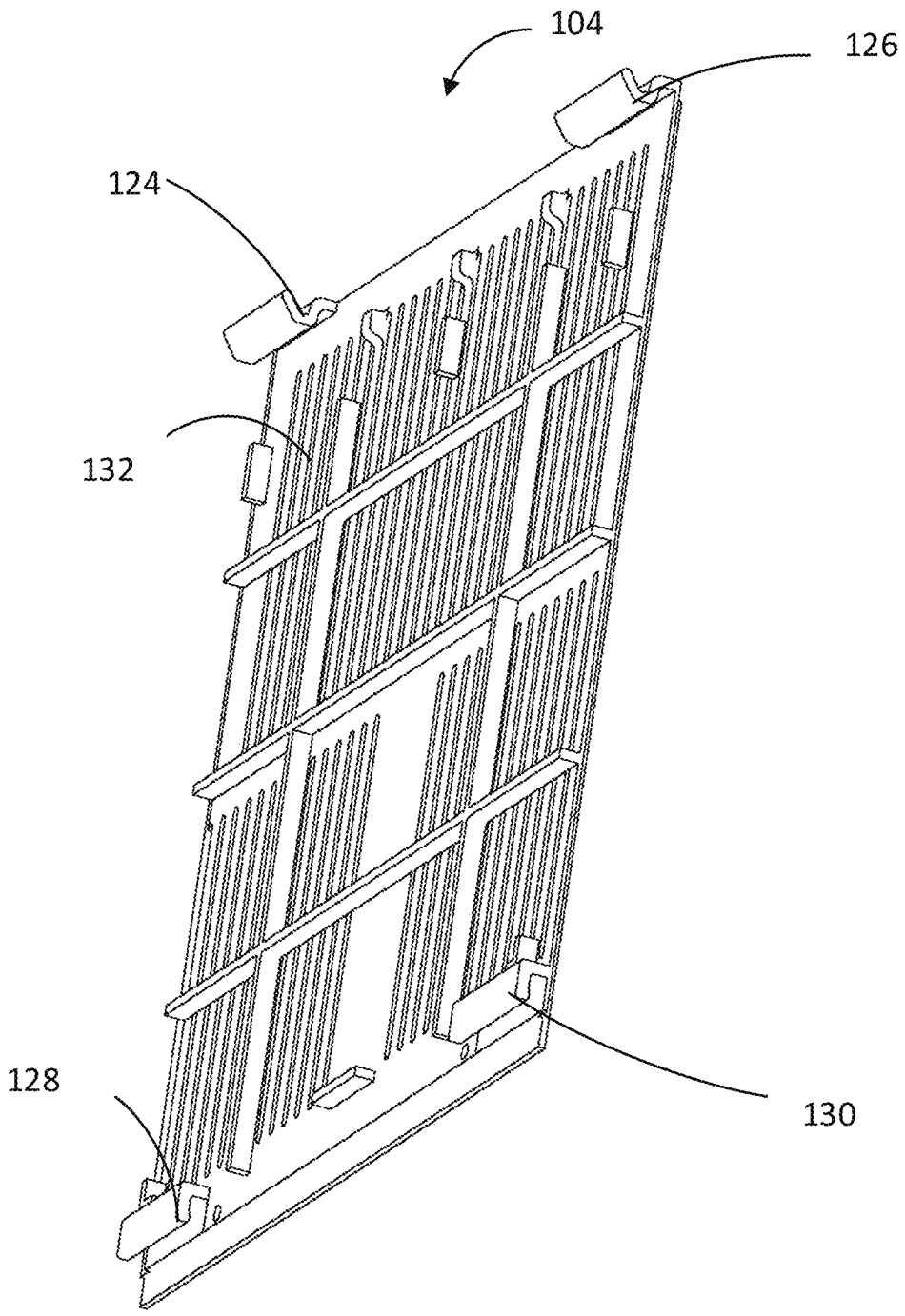
FIG. 5 shows rear view of the exemplary wall panel shown in FIG. 4.

With reference now to FIG. 5, a rear surface 132 of the face panel 104 is shown. When attached to the wall beam 102, the rear surface 132 faces the wall beam 102 so that the rear surface 132 is enclosed within the beam assembly 100. As further shown, the face panel 104 further includes upper clips 124, 126 and lower clips 128, 130 for securing the face panel 104 to the wall beam 102 as discussed further below.

Figure 6:
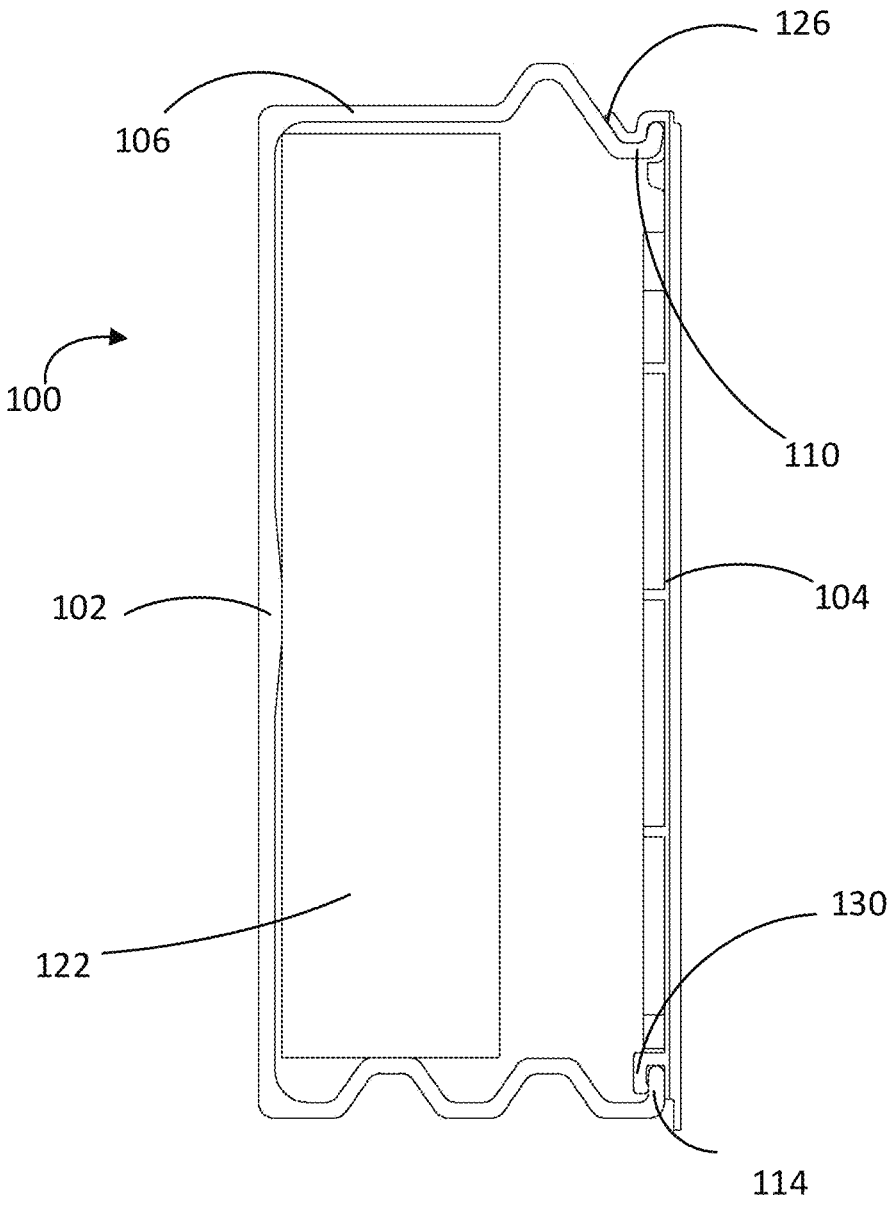
FIG. 6 shows a side cutaway view of a beam wall assembly including insulation in accordance with a preferred embodiment of the present invention.

With reference now to FIG. 6, a side cutaway view of a fully assembled beam wall assembly 100 is shown. As shown, the face panel 104 is attached to the wall beam 102 preferably at two points. According to a preferred embodiment, the face panel 104 may be attached by inserting one or more lower clips 130 (clip 128 not shown) of the face panel 104 over the lower connecting flange 114 and then pressing the upper clips 126 (clip 124 not shown) against the upper connecting flange 110 so that the upper surface 106 bends and the upper clip 126 snaps over the upper connecting flange 110 to create a frictional/tension fit. As further shown in FIG. 6, the beam wall assembly 100 may preferably enclose foam insulation 122 or the like to aid noise reduction. According to a preferred embodiment, the foam insulation 122 may preferably be sufficient to provide a Noise Rating Coefficient (NRC) greater than 0.85 and a Sound Transmission Class (STC) above 30.

Figure 7:
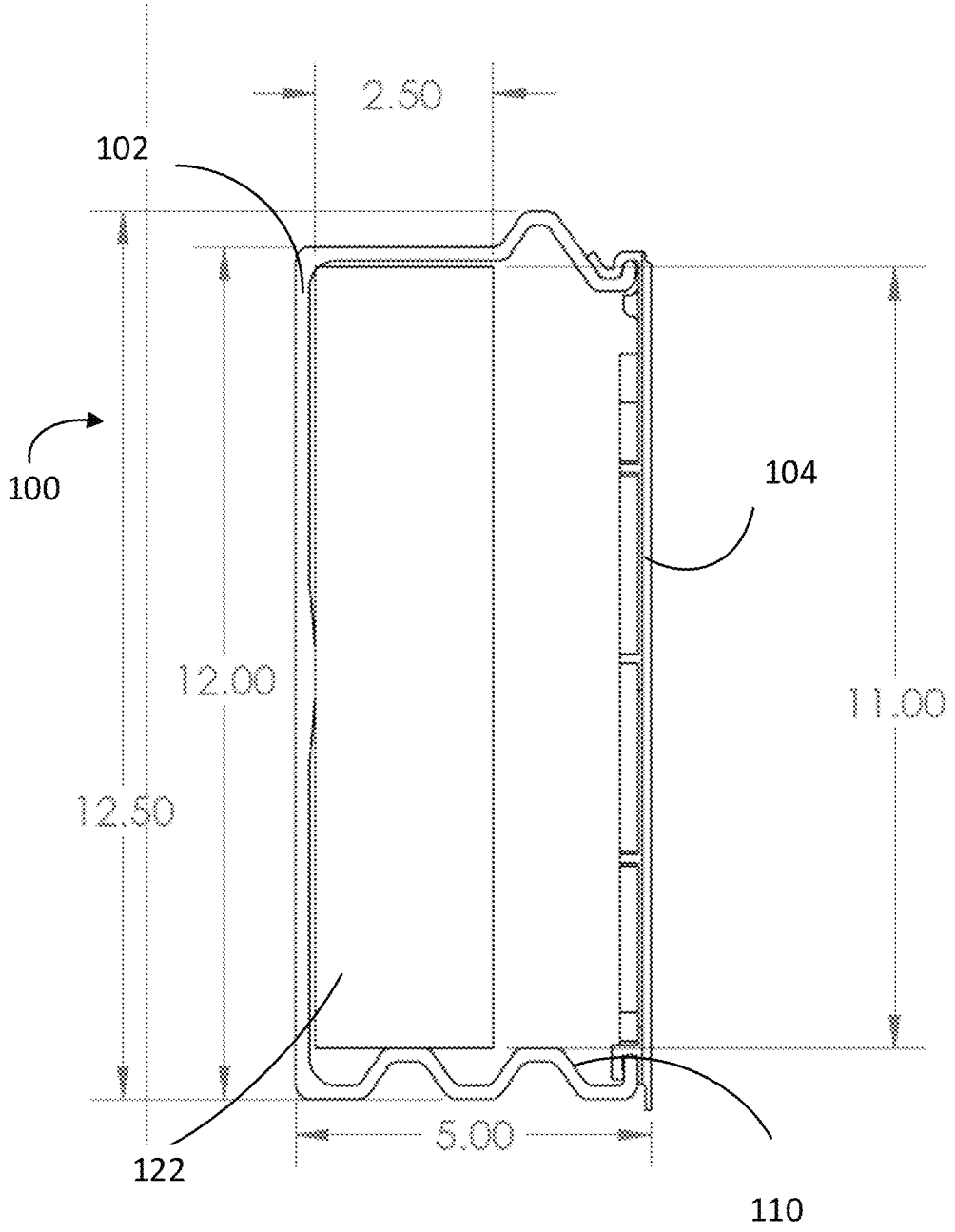
FIG. 7 shows a side cutaway view of the beam wall assembly shown in FIG. 6 labelled with exemplary dimensions.

FIG. 7 shows a side cutaway view of the beam wall assembly 100 shown in FIG. 6 labelled with exemplary dimensions. As shown, the beam wall assembly 100 may preferably be approximately 12.5 inches in total height with 11 inches of the front face 105 visible.

Figure 8:
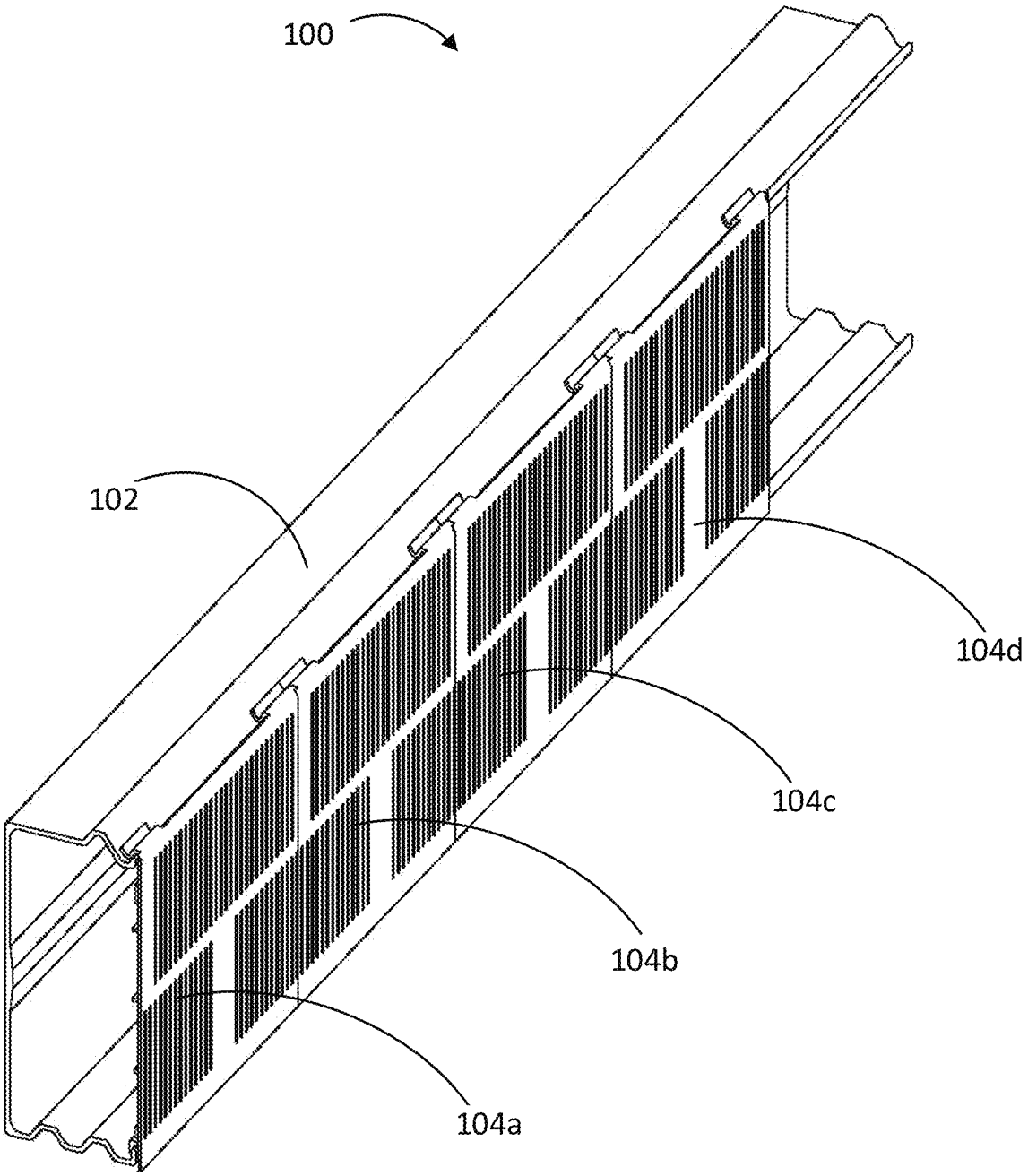
FIG. 8 shows a perspective view an extended beam wall assembly in accordance with a further preferred embodiment of the present invention.

FIG. 8 shows a perspective view of an extended beam wall assembly 100 in accordance with a further preferred embodiment of the present invention. As shown, a single wall beam 102 may be of any length and may attach to any number of face panels 104*a-d* as needed to extend horizontally. Further, each wall beam 102 may be stacked with other wall beams as shown in FIG. 9. As shown, groups of wall beam assemblies 100*a*-100*d* preferably interlock to form a wall of the desired height. FIG. 10 provides an example of a fully formed wall 134 which includes multiple, stacked wall assemblies and faux brick face panels.

While this invention has been described and illustrated with reference to particular embodiments, it will be readily apparent to those skilled in the art that the scope of the invention is not limited to the disclosed embodiments but, on the contrary, is intended to cover numerous other modifications and equivalent arrangements which are included within the spirit and scope of the following claims.

The above descriptions of illustrated embodiments of the present invention are not intended to be exhaustive or to limit the present invention to the precise forms disclosed. It should be understood that various equivalent modifications are possible within the scope of the described embodiments as those skilled in the relevant art will recognize. Further, the elements of the various embodiments described above can be combined to provide further embodiments without limitation. These and other changes can be made to the disclosed system and apparatus in light of the above detailed description.

In the following claims, the terms used should not be construed to limit the specific embodiments disclosed in the specification and the claims, but instead the scope of the present invention is intended to be determined entirely by the claims.

What is claimed is:

1. A sound absorbing wall assembly system, wherein the wall assembly system comprises:

a first wall beam, wherein the first wall beam comprises:

an upper surface, wherein the upper surface comprises an upper corrugated rib, and an upper connecting flange;

a lower surface, wherein the lower surface comprises a lower corrugated rib and a lower connecting flange;

a back beam surface, wherein the back beam surface is connected between the upper surface and the lower surface; further wherein the back beam surface is substantially orthogonal to the upper surface and the lower surface;

a face panel, wherein the face panel comprises a front surface and a rear surface; wherein the front surface comprises a plurality of grill openings; wherein the rear surface is comprised of a plurality of upper clips and a plurality of lower clips; and insulation material, wherein the insulation material is enclosed between the first wall beam and the face panel;

wherein the face panel is attachable and detachable from the first wall beam; further wherein the face panel attaches to the first wall beam by inserting a lower clip of the face panel over the lower connecting flange and securing the upper clip over the upper connecting flange to create a tension fit.

2. The system of claim 1, wherein the first wall beam is formed of fiberglass.

3. The system of claim 1, wherein the first wall beam is substantially hollow.

4. The system of claim 3, wherein the back beam surface comprises a central interior ridge.

5. The system of claim 4, wherein the insulation material comprises foam insulation.

6. The system of claim 5, wherein the foam insulation is sufficient to provide a Noise Rating Coefficient (NRC) greater than 0.85 and a Sound Transmission Class (STC) greater than 30.

7. The system of claim 5, wherein the first wall beam is 12.5 inches in total height.

8. The system of claim 5, wherein the wall assembly system further comprises a second wall beam; wherein the first wall beam is configured to stack on the second wall beam to form a wall of a desired height.

9. The system of claim 8, wherein an upper surface of the second wall beam is flush with the lower surface of the first wall beam.

10. The system of claim 9, wherein an upper corrugated rib of the second wall beam sits within the lower corrugated rib of the first wall beam.

11. The system of claim 10, wherein the face panel is formed of a deformable plastic.

12. The system of claim 11, wherein the face panel is formed of nylon plastic.

13. The system of claim 10, wherein the face panel comprises a wired mesh.

14. The system of claim 10, wherein the lower clips of the face panel are configured to receive and fictionally secure the lower connecting flange of the first wall beam.

15. The system of claim 14, wherein the upper clips of the panel are configured to receive and secure the upper connecting flange of the first wall beam.

16. The system of claim 15, wherein the face panel is configured to attach to the first wall beam by the insertion of at least one lower clip over the lower connecting flange and by the pressing of at least one upper clip against the upper connecting flange so that at least one surface of the wall beam bends to allow the at least one upper clip to slide over the upper connecting flange to create a tension fit.

* * * * *